US011851974B1

(12) United States Patent
Ejim

(10) Patent No.: US 11,851,974 B1
(45) Date of Patent: Dec. 26, 2023

(54) RESETTABLE PACKER SYSTEM FOR PUMPING OPERATIONS

(71) Applicant: SAUDI ARABIAN OIL COMPANY, Dhahran (SA)

(72) Inventor: Chidirim Enoch Ejim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/822,728

(22) Filed: Aug. 26, 2022

(51) Int. Cl.
*E21B 33/124* (2006.01)
*E21B 33/127* (2006.01)

(52) U.S. Cl.
CPC ..... *E21B 33/1243* (2013.01); *E21B 33/127* (2013.01); *E21B 33/1246* (2013.01)

(58) Field of Classification Search
CPC ..... E21B 33/1243; E21B 33/1246; E21B 33/1275; E21B 33/128; E21B 33/1285; E21B 33/126; E21B 33/127
See application file for complete search history.

(56) References Cited

U.S. PATENT DOCUMENTS 2,745,496 A * 5/1956 Blood ..... E21B 33/127 277/331
2,942,667 A * 6/1960 Bridwell ..... E21B 21/00 175/325.2
3,364,993 A * 1/1968 Uvon ..... E21B 47/117 166/207
3,876,000 A * 4/1975 Nutter ..... E21B 49/088 166/147
5,404,946 A * 4/1995 Hess ..... E21B 33/1275 166/325
5,465,628 A * 11/1995 Timmons ..... G01N 33/246 73/864.34
5,833,001 A * 11/1998 Song ..... E21B 29/10 166/57
8,955,606 B2 * 2/2015 O'Malley ..... E21B 43/103 166/123
2004/0188096 A1 9/2004 Traylor
2012/0261127 A1 * 10/2012 Zhou ..... E21B 21/103 166/118
2014/0083702 A1 * 3/2014 Godfrey ..... C09K 8/518 166/295

(Continued)

FOREIGN PATENT DOCUMENTS

WO 2019122835 A1 6/2019

*Primary Examiner* — Yong-Suk (Philip) Ro
(74) *Attorney, Agent, or Firm* — Osha Bergman Watanabe & Burton LLP

(57) ABSTRACT

A resettable packer system for pumping operations includes an inflatable packer that expands between the resettable packer system and a tubing wall or a casing wall, thereby creating a seal in a well and a pump that inflates the inflatable packer at a desired depth within the well when activated. The resettable packer system further includes an inner sleeve that includes ports for a fluid to pass through, an outer sleeve that is connected to the pump and creates a sealed fluid chamber with the inflatable packer when ports of the outer sleeve and the ports of the inner sleeve are misaligned. In addition, the inner sleeve slides axially along an inner surface of the outer sleeve, thereby aligning or misaligning the ports of the outer sleeve with the ports of the inner sleeve. Further, the inflatable packer contracts when the pump is inactive.

20 Claims, 10 Drawing Sheets

(56) References Cited

U.S. PATENT DOCUMENTS

| | | | | |
|---|---|---|---|---|
| 2014/0166277 | A1* | 6/2014 | Ade-Fosudo | E21B 47/06 166/66.4 |
| 2015/0267501 | A1* | 9/2015 | Al-Gouhi | E21B 33/12 166/299 |
| 2017/0145801 | A1* | 5/2017 | Hazel | E21B 33/1243 |

* cited by examiner

RESETTABLE PACKER SYSTEM FOR PUMPING OPERATIONS

BACKGROUND

Hydrocarbon fluids are located below the surface of the Earth in subterranean porous rock hydrocarbon-bearing formations called "reservoirs." In order to extract the hydrocarbon fluids, wells may be drilled to gain access to the reservoirs. Drilling operations may include well construction activities, such as casing the wellbore, subsequent to completion of drilling a section of the wellbore. Here, the drill string may be pulled out of the wellbore and a section of casing may be deployed and cemented into place to create fluid and mechanical isolation from the newly drilled formation.

Production tubing is then typically installed for the purpose of recovering reservoir fluids. In the process, an annular gap or space between the production tubing and surrounding casing (or other tubular) is bridged via a production packer. In so doing, an annular volume above the packer is effectively sealed off from an annular volume below the packer to prevent or inhibit migration of fluids or gases (of any type) between the lower and upper annular volumes. Commonly, inflatable packers are utilized to seal off portions of a well. Inflatable packers are generally designed to radially expand when fluid is injected into the packer.

SUMMARY

A resettable packer system for pumping operations includes an inflatable packer that expands between the resettable packer system and a tubing wall or a casing wall, thereby creating a seal in a well and a pump that inflates the inflatable packer at a desired depth within the well when activated. The resettable packer system further includes an inner sleeve that includes ports for a fluid to pass through, an outer sleeve that is connected to the pump and creates a sealed fluid chamber with the inflatable packer when ports of the outer sleeve and the ports of the inner sleeve are misaligned. In addition, the inner sleeve slides axially along an inner surface of the outer sleeve, thereby aligning or misaligning the ports of the outer sleeve with the ports of the inner sleeve. Further, the inflatable packer contracts when the pump is inactive.

A method for setting and unsetting a resettable packer system includes sliding an inner sleeve of the resettable packer system axially along an inner surface of an outer sleeve of the resettable packer system, thereby aligning and misaligning ports of the inner sleeve and ports of the outer sleeve. When the ports of the inner sleeve and the ports of the outer sleeve align, a fluid passes through the ports of the inner sleeve and the ports of the outer sleeve, and when the ports of the inner sleeve and the ports of the outer sleeve misalign, the fluid is prevented from passing through the ports of the inner sleeve and the ports of the outer sleeve. The method further includes activating a pump of the resettable packer system at a desired depth in a well, pumping the fluid into a sealed fluid chamber between the outer sleeve and an inflatable packer by the activated pump, thereby inflating the inflatable packer, and sealing the well between the resettable packer system and a tubing wall or a casing wall by the inflated packer. In addition, the method further includes performing a pumping operation within the well and deactivating the pump, thereby contracting the inflatable packer.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the Earth than a corresponding "lower" element when in a downhole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

In one or more embodiments, this disclosure describes systems and methods of setting and unsetting a resettable packer system for pumping operations. The operation for a rigless or cable deployed system is presented; however, embodiments disclosed herein are also applicable to tubing deployed pumping systems. The application of this packer system is beneficial during downhole equipment installation, where a packer is required to be set at different depths within a wellbore. For example, the resettable packer system may be used when lifting liquid from a loaded well, where the depth needs to be changed to optimize the liquid lifting process. In one or more embodiments, the resettable packer system includes a sliding inner sleeve, a fixed outer sleeve, and an inflatable packer. The techniques discussed in this disclosure are beneficial in reducing the total time of pumping operations and, thus, the associated costs.

Figure 1:
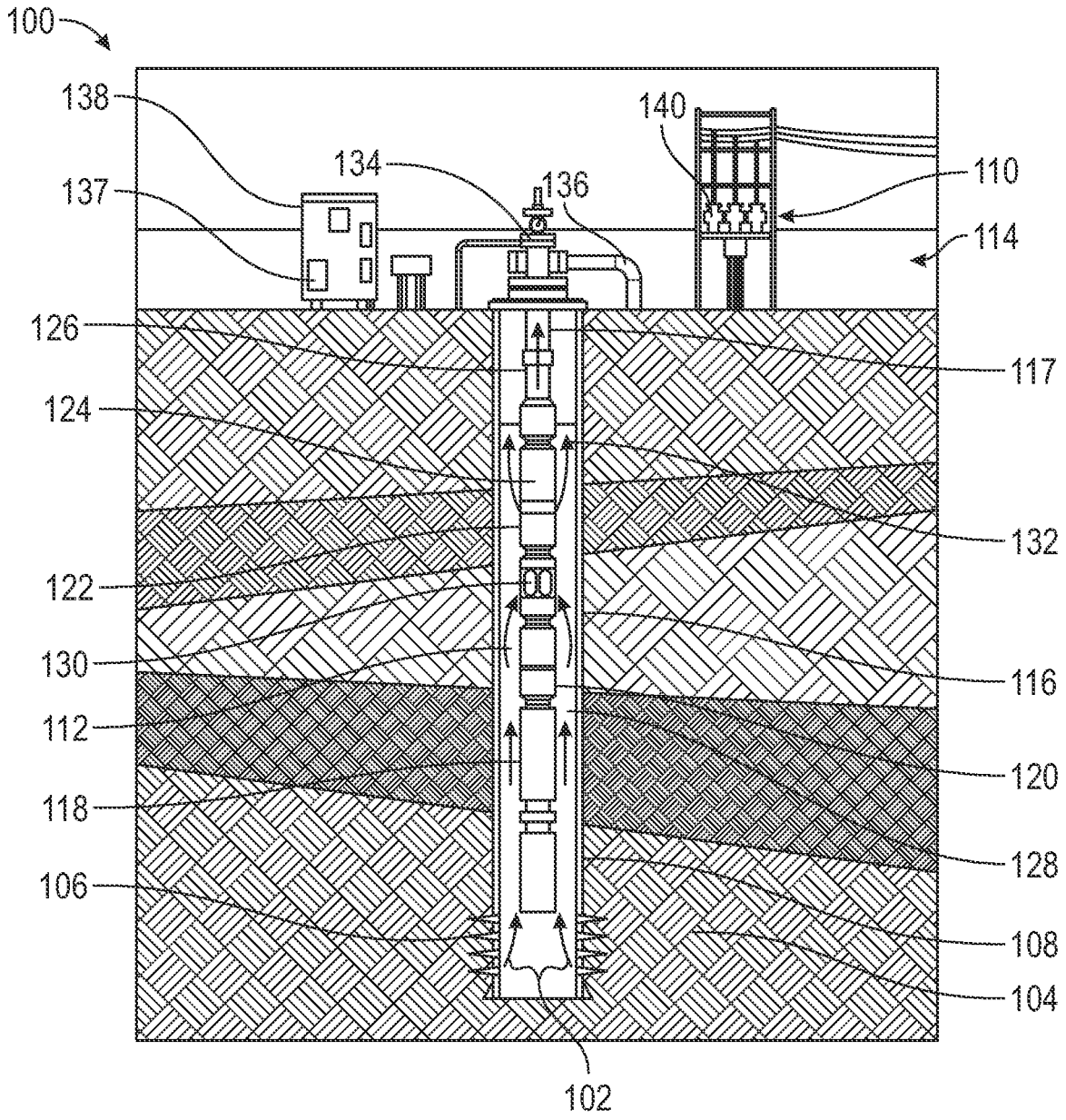
FIG. 1 shows an exemplary well with an Electrical Submersible Pump (ESP) completion design in accordance with one or more embodiments.

FIG. 1 shows an exemplary ESP system (100) in accordance with one or more embodiments. The ESP system (100) is used to help produce formation fluids (102) from a formation (104). Perforations (106) in the well casing (108) provide a conduit for the formation fluids (102) to enter the well (116) from the formation (104). The well (116) may be of vertical orientation or deviated at an angle. A deviated well (116) is well known in the art. The ESP system (100) includes a surface portion having surface equipment (110) and a downhole portion having an ESP string (112).

The ESP string (112) is deployed in a well (116) on production tubing (117) and the surface equipment (110) is located on a surface location (114). The surface location (114) is any location outside of the well (116), such as the Earth's surface. The production tubing (117) extends to the surface location (114) and is made of a plurality of tubulars connected together to provide a conduit for formation fluids (102) to migrate to the surface location (114).

The ESP string (112) may include a motor (118), a motor protector (120), a gas separator (122), a multi-stage centrifugal pump (124) (herein called a "pump" (124)), and a power cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor, permanent magnet motor, or another suitable motor (118). The motor's (118) operating voltages, currents, and horsepower ratings may change depending on the requirements of the operation.

The size of the motor (118) is dictated by the amount of power that the pump (124) requires to lift an estimated volume of formation fluids (102) from the bottom of the well (116) to the surface location (114). The motor (118) is cooled by the formation fluids (102) passing over the motor (118) housing. The motor (118) is powered by the power cable (126). The power cable (126) is an electrically conductive cable that is capable of transferring information. The power cable (126) transfers energy from the surface equipment (110) to the motor (118). The power cable (126) may be a three-phase electric cable that is specially designed for downhole environments. The power cable (126) may be clamped to the ESP string (112) in order to limit power cable (126) movement in the well (116). In further embodiments, the ESP string (112) may have a hydraulic line that is a conduit for hydraulic fluid. The hydraulic line may act as a sensor to measure downhole parameters such as discharge pressure from the outlet of the pump (124).

Motor protectors (120) are located above (i.e., closer to the surface location (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from formation fluids (102). The seals further equalize the pressure in the annulus (128) with the pressure in the motor (118). The annulus (128) is the space in the well (116) between the casing (108) and the ESP string (112). The pump intake (130) is the section of the ESP string (112) where the formation fluids (102) enter the ESP string (112) from the annulus (128).

The pump intake (130) is located above the motor protectors (120) and below the pump (124). The depth of the pump intake (130) is designed based off of the formation (104) pressure, estimated height of formation fluids (102) in the annulus (128), and optimization of pump (124) performance. If the formation fluids (102) have associated gas, then a gas separator (122) may be installed in the ESP string (112) above the pump intake (130) but below the pump (124). The gas separator (122) removes the gas from the formation fluids (102) and injects the gas (depicted as separated gas (132) in FIG. 1) into the annulus (128). If the volume of gas exceeds a designated limit, a gas handling device may be installed below the gas separator (122) and above the pump intake (130).

The pump (124) is located above the gas separator (122) and lifts the formation fluids (102) to the surface location (114). The pump (124) has a plurality of stages that are stacked upon one another. Each stage contains a rotating impeller and stationary diffuser. As the formation fluids (102) enter each stage, the formation fluids (102) pass through the rotating impeller to be centrifuged radially outward gaining energy in the form of velocity.

The formation fluids (102) enter the diffuser, and the velocity is converted into pressure. As the formation fluids (102) pass through each stage, the pressure continually increases until the formation fluids (102) obtain the designated discharge pressure and has sufficient energy to flow to the surface location (114). The ESP string (112) outlined in FIG. 1 may be described as a standard ESP string (112), however, the term ESP string (112) may be referring to a standard ESP string (112) or an inverted ESP string (112) without departing from the scope of the disclosure herein.

In one or more embodiments, sensors may be installed in various locations along the ESP string (112) to gather downhole data such as pump intake pressures, discharge pressures, and temperatures. The number of stages is determined prior to installation based of the estimated required discharge pressure. Over time, the formation (104) pressure may decrease and the height of the formation fluids (102) in the annulus (128) may decrease. In these cases, the ESP string (112) may be removed and resized. Once the formation fluids (102) reach the surface location (114), the formation fluids (102) flow through the wellhead (134) into production equipment (136). The production equipment (136) may be any equipment that can gather or transport the formation fluids (102) such as a pipeline or a tank.

The remainder of the ESP system (100) includes various surface equipment (110) such as electric drives (137) and pump control equipment (138) as well as an electric power supply (140). The electric power supply (140) provides energy to the motor (118) through the power cable (126).

The electric power supply (140) may be a commercial power distribution system or a portable power source such as a generator.

The pump control equipment (138) is made up of an assortment of intelligent unit-programmable controllers and drives which maintain the proper flow of electricity to the motor (118) such as fixed-frequency switchboards, soft-start controllers, and variable speed controllers. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

Figure 2:
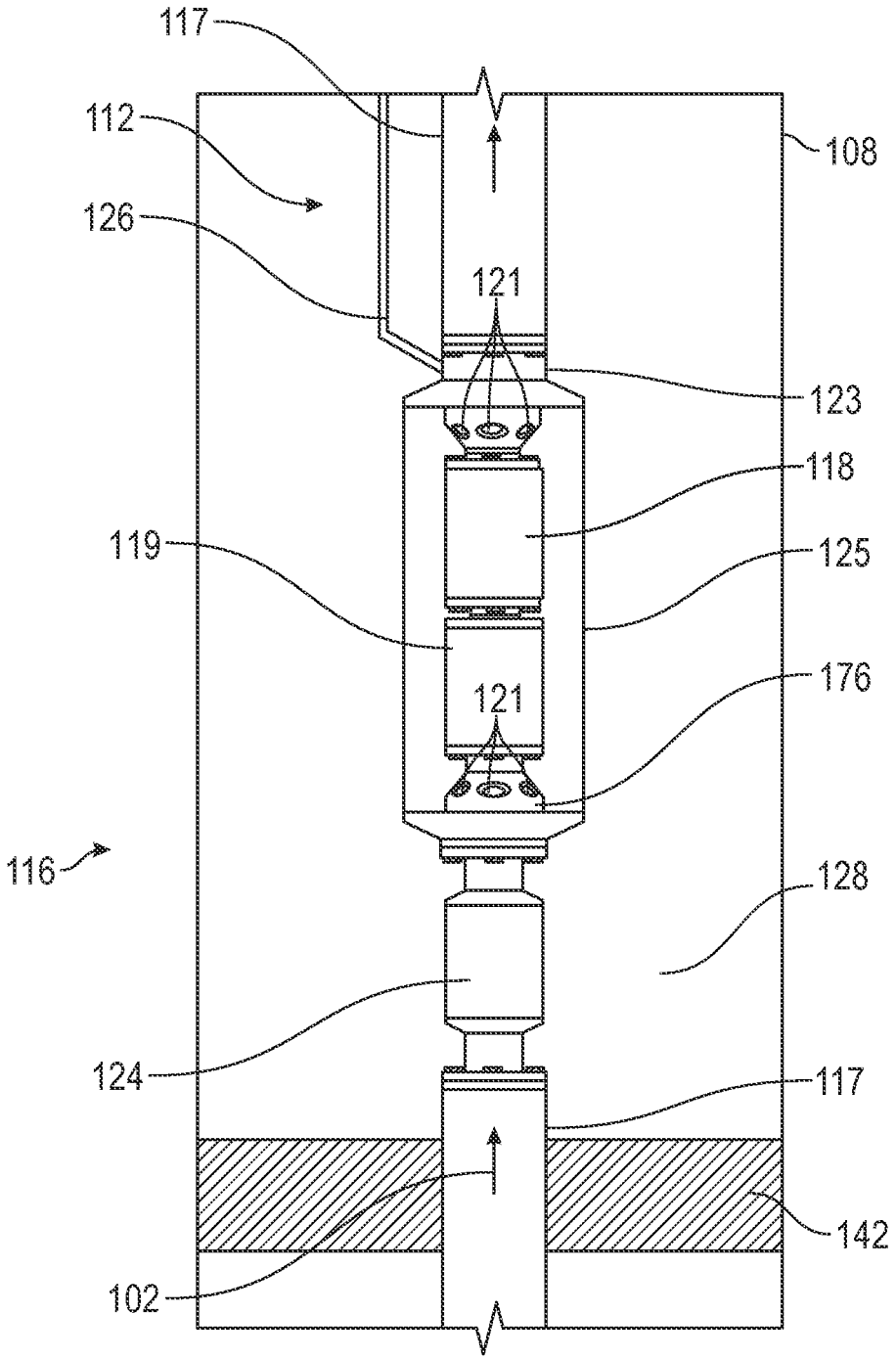
FIG. 2 shows an inverted ESP string in accordance with one or more embodiments.

FIG. 2 shows an inverted ESP string (112) in accordance with one or more embodiments. Components shown in FIG. 2 that have been described in FIG. 1 have not been redescribed for purposes of readability and have the same description and purpose as outlined above. The inverted ESP string (112) shown in FIG. 2 has the pump (124) located downhole from the motor (118), whereas in FIG. 1, the pump (124) is located up hole from the motor (118). Further, the production tubing (117) of the inverted ESP string (112) design traverses a packer (142). The packer (142) is set within the casing (108) of the well (116). A motor (118), an ESP seal (119), and a pump (124) are connected to the production tubing (117) and are located up hole from the packer (142). The packer (142) may be any packer (142) known in the art such as a mechanical packer (142). The packer (142) seals the annulus (128) space located between the inverted ESP string (112) and the casing (108). This prevents the formation fluids (102) from migrating past the packer (142) in the annulus (128).

The ESP seal (119) may contain one or more seals used to prevent fluid from entering the motor (118). In accordance with one or more embodiments, the ESP seal (119) may be similar to the motor protectors (120) as described in FIG. 1. The ESP seal (119) is connected to the discharge (176). The discharge (176) may include a plurality of holes (121) and may not be machined as part of the pump (124). The holes (121) enable a fluid, such as the formation fluid (102), to exit the discharge (176).

In this non-limiting example, the inverted ESP string (112) includes a motor head (123) and a shroud (125). The motor head (123) enables the electrical connections between the power cable (126) and the motor (118) to occur in an environment absent of the formation fluid (102). Further, the motor head (123) extends into the shroud (125) such that holes (121) of the motor head (123), the motor (118), the ESP seal (119), and the holes (121) of the discharge (176) are encapsulated by the shroud (125). The shroud (125) is formed in a cylindrical-like shape around the aforementioned encapsulated elements of the inverted ESP string (112). The shroud (125) encapsulates and isolates these elements from an external environment and contains a flow of the formation fluids (102) coming from the production tubing (117). The shroud (125) may be made out of any durable material known in the art, such as steel.

The power cable (126) is connected to a portion of the motor head (123) that is located in the external environment outside of the shroud (125) and up hole from the packer (142). Thus, the power cable (126) to motor head (123) connection may be performed in an environment with no formation fluid (102).

In accordance with one or more embodiments, the formation fluid (102) enters the well (116) through perforations (106) in the casing (108). The formation fluid (102) travels up hole using the production tubing (117). Then, the formation fluid (102) enters the pump (124), powered by the motor (118). Here, the pump (124) pumps the formation fluid (102) into the shroud (125) through the holes (121) of the discharge (176). Subsequently, the formation fluid (102) bypasses the ESP seal (119) and the motor (118), while inside of the shroud (125), and enters the motor head (123) through the holes (121) of the motor head (123). Finally, the formation fluid (102) travels from the motor head (123) back into the production tubing (117) where the pump pressure provided by the pump (124) pushes the formation fluids (102) to the surface location (114).

In ESP systems (100), conventional procedures require the use of a plug to be run in the hole to set a packer (142). The plug inside of the production tubing (117) may be used to create a barrier to allow the application of differential pressure required to set the packer (142). Once the packer (142) is set, the plug must be retrieved resulting in high costs and long times.

ESP systems (100) have applications in different oilfield operations and are desired for their high-volume flow rates and pressure boosting capabilities. One application may be during installation of a rigless pumping system, for example when attempting to lift formation fluid (102) to the surface location (114) from a loaded well (116). In some instances, while the pump (124) is connected with the packer (142), it may be desired to change the packer (142)/pump (124) setting depth, perhaps to optimize the liquid-lifting process. To accomplish this, a first operation is run to retrieve the entire pumping system to the surface. Next, an additional operation is necessary to unset the packer (142) and deploy it to the new setting depth. A further operation is required to re-install the pumping system back into the well (116) to latch into the packer (142) at the new setting depth. The above process increases the total time and costs required to complete the operations and to bring production online. As such, embodiments disclosed in FIGS. 3-9 present systems and methods of setting and unsetting a resettable packer system (144) for pumping operations that include a sliding inner sleeve (146), a fixed outer sleeve (148), and an inflatable packer (150). The resettable packer system (144) may be set and unset a number of times in a single operation without the need of retrieving the entire pumping system, minimizing the time and associated costs of pumping operations.

Figure 3:
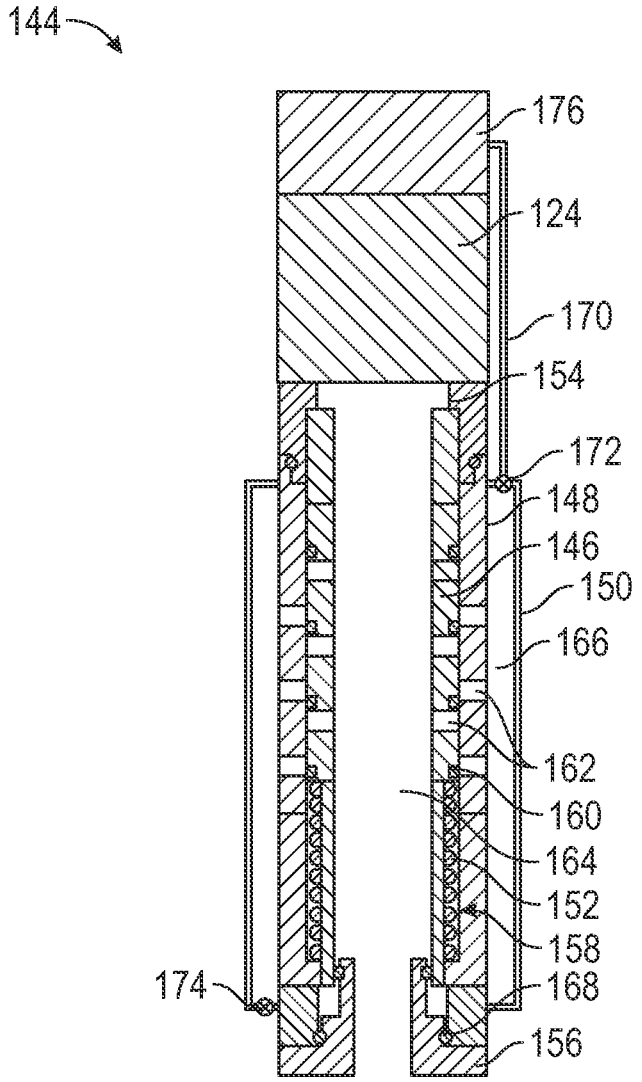
FIG. 3 shows a cross-sectional view of a resettable packer system in accordance with one or more embodiments of the present disclosure.

FIG. 3 shows a cross-sectional view of a resettable packer system (144) in accordance with one or more embodiments of the present disclosure. Here, the resettable packer system (144) includes an inflatable packer (150), a pump (124), an outer sleeve (148), an inner sleeve (146), and a spring (152), and is configured to be attached to the downhole end of an ESP system (100) within a well (116). The resettable packer system (144) may be flanged or threaded directly to the to the downhole end of the ESP system (100). The inflatable packer (150) may be formed of an elastomeric or flexible material suited for expanding and contracting, such as Kevlar, polymers, polyesters, nanocellulose, or natural materials such as cotton, wool, silk, or linen. Accordingly, the inflatable packer (150) is configured to create a seal in the well (116) by expanding from the resettable packer system (144) to a tubing (117) wall or a casing (108) wall. The pump (124), disposed an upper end of the resettable packer system (144), is configured to inflate the inflatable packer (150) at a desired depth in the well (116) when activated. Located below the pump (124) are the outer sleeve (148) and inner sleeve (146) of the resettable packer system (144). Both the outer sleeve (148) and inner sleeve (146) are tubular shaped and formed of a durable material, such as steel. The outer sleeve (148) is rigidly fixed to a wedge (154) and a base (156) of the resettable packer system (144) by threaded connections while the inner sleeve (146) is connected to a spring (152) and may slide axially along an inner surface (158) of the outer sleeve (148). Further, the inflatable packer (150) may be bonded to the outer sleeve (148) during the manufacturing process of the resettable packer system (144).

The spring (152) is disposed within a cavity between the inner sleeve (146) and outer sleeve (148). In addition, the spring (152) may be formed of high-carbon, alloy, or stainless steel and is a compression spring (152). The cavity in which the spring (152) is located is isolated from formation fluid (102) by rubber or elastomer seals (160) above and below the spring (152). The stiffness and contraction length of the spring (152) are selected to match a required spring force needed to move the inner sleeve (146) based on the final desired setting depth and the formation fluid (102) properties. The wedge (154), located at the upper end of resettable the packer system (144), limits the axial upward movement of the inner sleeve (146), whereas the base (156), located at the downhole end of the resettable packer system (144), limits the axial downward movement of the inner sleeve (146). The wedge (154) and base (156) may also be formed of a durable material, such as steel.

Further, the outer sleeve (148) and inner sleeve (146) both include ports (162). These ports (162) are slots disposed within the outer sleeve (148) and inner sleeve (146) and are configured for the formation fluid (102) to pass through. When the ports (162) of the outer sleeve (148) and the inner sleeve (146) are aligned, formation fluid (102) may travel between the inflatable packer (150) and a bore (164) of the resettable packer system (144). However, when the ports (162) are misaligned, fluid communication between the bore (164) and the inflatable packer (150) is lost as a sealed fluid chamber (166) is formed between an outer surface of the outer sleeve (148) and an interior of the inflatable packer (150). Seals (160) are utilized to prevent formation fluid (102) from passing through the gap between the outer sleeve (148) and inner sleeve (146) when the ports (162) of the outer sleeve (148) and inner sleeve (146) are misaligned. In addition, a rubber or elastomer material O-ring (168) is disposed between the base (156) and the outer sleeve (148) in order to prevent formation fluid (102) from entering into or exiting out of the system (144).

The resettable packer system (144) also includes a control line (170), a check valve (172), and a pressure relief valve (174). The control line (170) may be a ⅛-inch diameter conduit for introducing formation fluid (102) into the inflatable packer (150) and is typically connected to a pressure supply source which may be, for example, a discharge (176). Thus, the packer system (144) is connected to the pump by the control line (170), which supplies pressurized fluid to the packer (150). The control line (170) and the inflatable packer (150) are connected by the check valve (172). The check valve (172) is configured to control a flow (178) of the formation fluid (102) in a single direction. With respect to the discharge (176) and the inflatable packer (150), the check valve (172) controls the direction of the flow (178) (e.g., shown in FIGS. 4C-4F) of the formation fluid (102) such that the formation fluid (102) only flows from the discharge (176) to the inflatable packer (150). Further, a pressure relief valve (174) disposed along the inflatable packer (150) may be employed to eject formation fluid (102) from the fluid chamber (166) should the pressure within the inflatable packer (150) exceed a pressure threshold. The pressure threshold is determined by an operator of the well (116) according to the design limits of the inflatable packer (150) or to a manufacturer's suggestion. In addition, the pressure relief valve (174) may be located along an upper surface or downhole surface of the inflatable packer (150) so that the formation fluid (102) may escape into the production tubing (117) or casing (108).

Figure 4D:
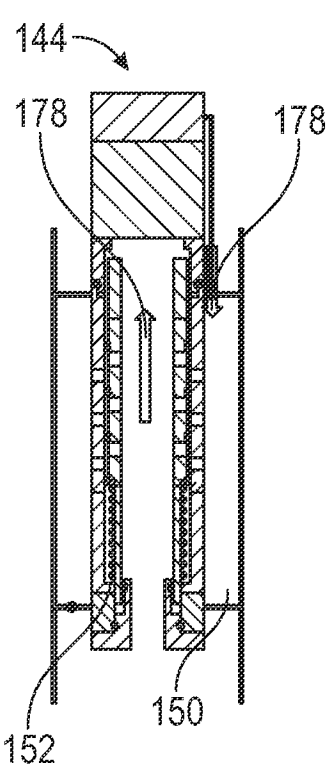
FIGS. 4A-4G depict the operational sequence of the system in accordance with one or more embodiments.
Figure 4C:
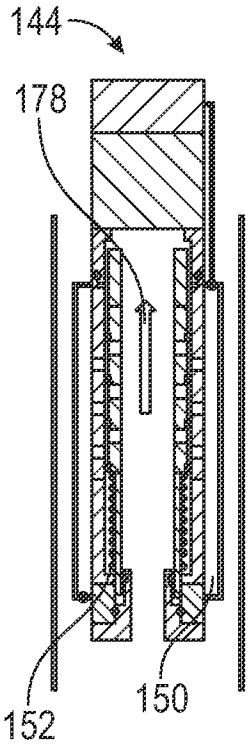
Figure 4B:
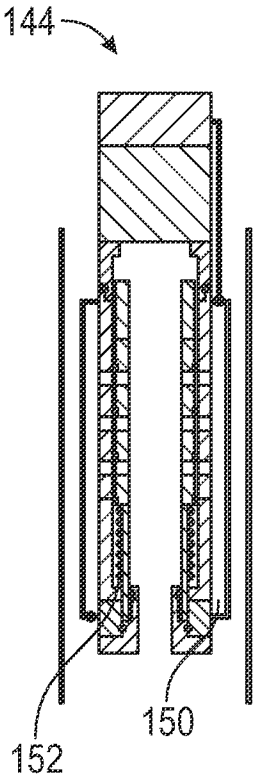
Figure 4A:
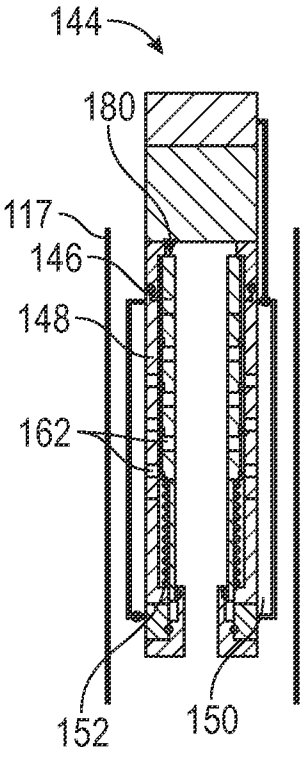

FIGS. 4A-4G depict the operational sequence of the resettable packer system (144) in accordance with one or more embodiments. Specifically, FIG. 4A depicts the system (144) at the surface location (114) and before the installation of the system (144) within the well (116). Before being lowered downhole, the spring (152) presses a top surface (180) of the inner sleeve (146) against a portion of the wedge (154) which protrudes inwardly, towards the bore (164) of the resettable packer system (144). At this initial position, the ports (162) of the outer sleeve (148) and the inner sleeve (146) are misaligned.

As the resettable packer system (144) is lowered into the well (116) prior to reaching a desired setting depth, the top surface (180) of the inner sleeve (146), which is exposed to formation fluid (102), experiences a hydrostatic pressure that increases with depth. This hydrostatic pressure pushes downward on the inner sleeve (146) and thereby compressing the spring (152) more than at the surface location (114). An upward force of the spring (152) on the inner sleeve (146) is balanced by a downward force that is a sum of a net hydrostatic force on the inner sleeve (146), a frictional resistance force of the seals (160) against the inner surface (158) of the outer sleeve (148), and a net weight of the inner sleeve (146).

In FIG. 4B, the system (144) is located at the final setting depth. Here, the hydrostatic pressure ($P_{depth,no\text{-}flow}$), is higher than at the surface location (114). Therefore, the inner sleeve (146) is pushed downhole such that a bottom surface of the inner sleeve (146) rests against the base (156). In this position, the ports (162) of the outer sleeve (148) and inner sleeve (146) are aligned. In turn, there is fluid communication between the bore (164) of the resettable packer system (144) and the fluid chamber (166) disposed between the outer sleeve (148) and the inflatable packer (150). Consequently, formation fluid (102) begins to fill the fluid chamber (166).

At a desired final setting depth of the resettable packer system (144), the hydrostatic pressure ($P_{depth,no\text{-}flow}$) is highest when there is no flow (178), and thus the compression of the spring (152) is also the greatest at this point. When the pump (124) is activated, a majority of the formation fluid (102) flows upwards through the bore (164) of the resettable packer system (144) towards the ESP system (100) due to a high suction pressure created by the pump (124). Now, a new pressure ($P_{depth,flow}$) which acts on the top surface (180) of the inner sleeve (146) at the setting depth, becomes less than ($P_{depth,no\text{-}flow}$) This in turn yields a force imbalance and causing the spring (152) to push the inner sleeve (146) upwards, thereby misaligning the ports (162) of the outer sleeve (148) and the inner sleeve (146), as seen in FIG. 4C. In this position, the formation fluid (102) within the inflatable packer (150) is sealed off from the formation fluid (102) disposed in the well (116) and the bore (164) of the resettable packer system (144).

The control line (170) of the resettable packer system (144) is connected to the discharge (176). In FIG. 4D, the pump (124) has developed pressure which exceeds the pressure within the fluid chamber (166). Consequently, the high-pressure formation fluid (102) passing from the pump (124) to the discharge (176) is introduced into the fluid chamber (166) through the check valve (172). Therefore, the inflatable packer (150) is forced to expand until it makes contact with a solid surface, such as the tubing (117) wall or the casing (108) wall. The inflatable packer (150) then provides isolation between the high-pressure formation fluid (102) above the inflatable packer (150) and lower-pressure formation fluid (102) below the inflatable packer (150).

The pressure threshold of the inflatable packer (150) is determined prior to installation of the resettable packer system (144) based on a required sealing force. The required sealing force is a function of a total weight of the ESP system (100), a contact surface area of the inflatable packer (150) with the tubing (117) wall or casing (108) wall, and additional specifications familiar to a person skilled in the art. In addition, the pump (124) is sized to ensure it can at a minimum, supply a required pressure in the fluid chamber (166). If for any reason the pressure within the fluid chamber (166) exceeds the pressure threshold, the pressure relief valve (174) will open to bleed off excess formation fluid (102) into the well (116), thereby reducing the pressure inside the fluid chamber (166) to the design limits.

Figure 4G:
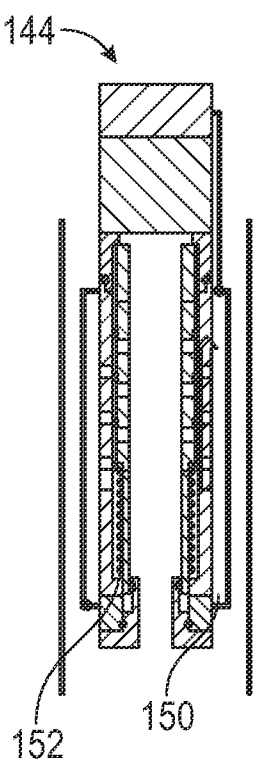
Figure 4F:
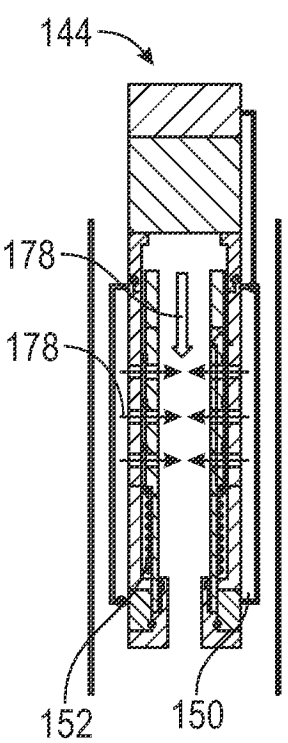
Figure 4E:
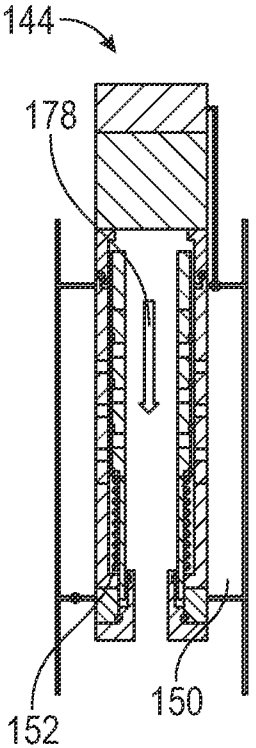

FIG. 4E depicts the system (144) if the desired setting depth needs to be changed. Here, the pump (124) is turned off, which immediately causes the direction of the flow (178) to change. At this instant, the ports (162) of the outer sleeve (148) and the inner sleeve (146) are still misaligned, causing high-pressure formation fluid (102) to still be trapped within the fluid chamber (166).

With the pump (124) deactivated, a static pressure at the top surface (180) of the inner sleeve (146) will begin to increase towards ($P_{depth,no\text{-}flow}$), similar to the scenario seen in FIG. 4B. The force associated with ($P_{depth,no\text{-}flow}$) will push downward on the inner sleeve (146) against the spring force, causing the ports (162) of the outer sleeve (148) and inner sleeve (146) to align with one another. In turn, fluid communication between the fluid chamber (166) and the bore (164) is re-established. Consequently, the high-pressure formation fluid (102) that was sealed within the fluid chamber (166) is released into the bore (164), thereby causing the inflatable packer (150) to contract and break contact with the tubing (117) wall or casing (108) wall, as seen in FIG. 4F.

Subsequent to the inflatable packer (150) contracting, the resettable packer system (144) may be removed from the well (116) or lifted up or down to a new desired setting depth. In order to re-set the inflatable packer (150), the steps described in FIGS. 4A-4D are repeated. After completion of the entire pumping operation, the steps described in FIG. 4E and FIG. 4F may be performed, and the entire system (144) may be retrieved to the surface location (114). Further, at the surface location (114), the positions of the outer sleeve (148) and inner sleeve (146) are shown in FIG. 4G, which is the same as the positions of the outer sleeve (148) and inner sleeve (146) in FIG. 4A.

Figure 5:
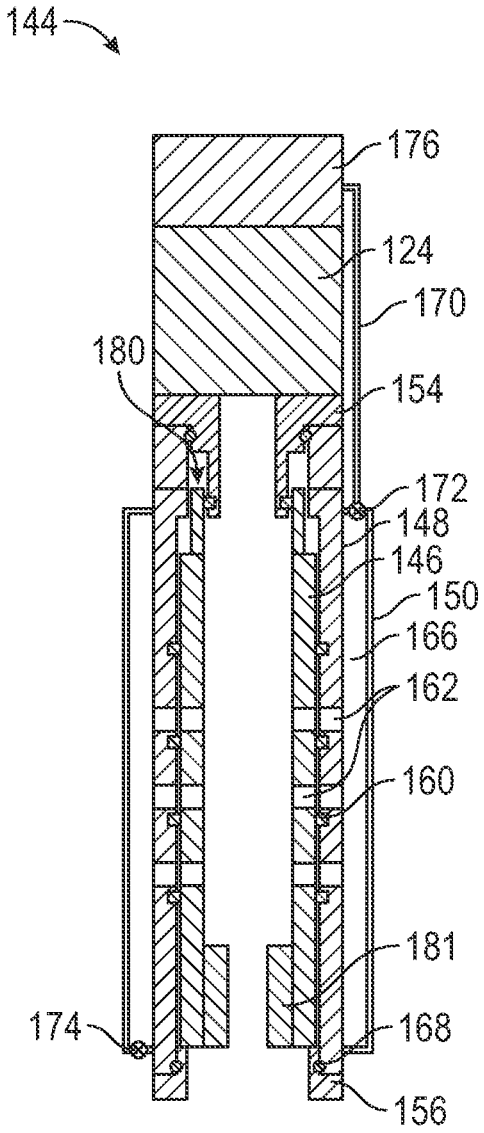
FIG. 5 shows a cross-sectional view of a resettable packer system in accordance with one or more embodiments of the present disclosure.

FIG. 5 shows another embodiment of a resettable packer system (144) in accordance with one or more embodiments of the present disclosure. Components shown in FIG. 5 that have been described in FIGS. 3 and 4 have not been redescribed for purposes of readability and have the same description and purpose as outlined above. However, in this embodiment, a drag force created by the flow (178) of the formation fluid (102) is utilized to slide the inner sleeve (146) of the resettable packer system (144).

Here, the top surface (180) of the inner sleeve (146), disposed between the outer sleeve (148) and the wedge (154), is sealed off from the formation fluid (102) by seals (160). In addition, the downhole end of the inner sleeve (146) includes a weighted section (181) exposed to the formation fluid (102). The weighted section (181) of the inner sleeve (146) protrudes from the inner sleeve (146) towards the bore (164) of the resettable packer system (144). Further, the weighted section (181) may be formed of a similar material as the inner sleeve (146) or of a denser or heavier material.

Similar to the embodiment described in FIGS. 3-4G, in this embodiment, the inner sleeve (146) rests on the upper surface of the base (156) when the ports (162) of the inner sleeve (146) and the ports (162) of the outer sleeve (148) are aligned, thereby permitting fluid communication between the bore (164) and fluid chamber (166) of the resettable packer system (144). The alignment of the ports (162) is achieved by the weight of the inner sleeve (146) and the weighted section (181). That is, a total downward force due to the combined weight of the inner sleeve (146) and the weighted section (181) (including frictional resistance of the seals (160) against the inner surface (158) of the outer sleeve (148)) is greater than a net hydrostatic force acting upwards on the downhole surface of the inner sleeve (146).

Figure 6C:
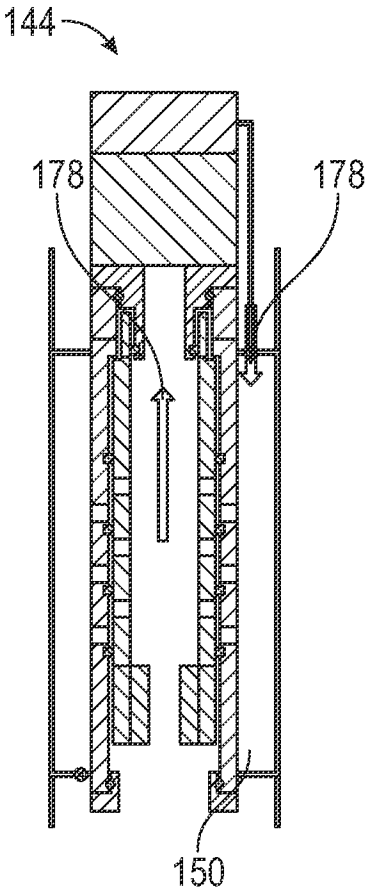
FIGS. 6A-6F depict the operational sequence of the system in accordance with one or more embodiments.
Figure 6B:
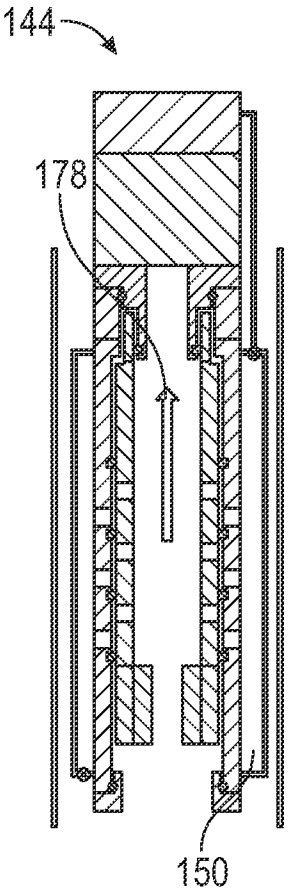
Figure 6A:
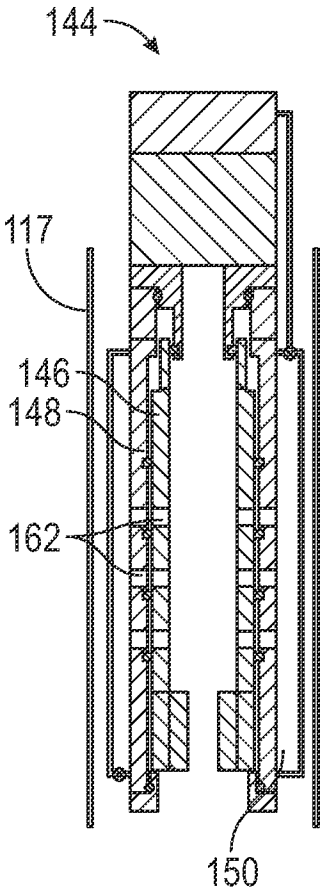

FIGS. 6A-6F depict the operational sequence of the system in accordance with one or more embodiments. Specifically, FIG. 6A depicts the resettable packer system (144) at the final setting depth within the well (116). In addition, the layout depicted in FIG. 6A is the same layout of the resettable packer system (144) at the surface location (114) prior to and during installation of the resettable packer system (144) within the well (116). Furthermore, FIG. 6A depicts the resettable packer system (144) before the pump (124) is turned on.

In FIG. 6B, upon activation of the pump (124), formation fluid (102) flows through the bore (164) of the resettable packer system (144) towards the pump (124) due to the suction force created by the pump (124). Consequently, the hydrostatic pressure upstream of the weighted section (181) is greater than the hydrostatic pressure downstream of the weighted section (181). The cross-sectional area of the combination of the weighted section (181) and the portion of the inner sleeve (146) in contact with the weighted section (181) is substantially greater than the cross-sectional area of the inner sleeve (146) just after the weighted section (181). These differences in hydrostatic pressures and cross-sectional areas create a net upward force, or drag, on the inner sleeve (146). In turn, this drag lifts and slides the inner sleeve (146) upwards within the resettable packer system (144), thereby misaligning the ports (162) of the inner sleeve (146) and the ports (162) of the outer sleeve (148). Subsequently, all flow (178) of the formation fluid (102) travels through the bore (164) of the resettable packer system (144), and the formation fluid (102) disposed within the fluid chamber (166) is now trapped. If more flow (178) is drawn in by the pump (124), the drag force increases, resulting in the inner sleeve (146) to be pushed further upwards towards the wedge (154).

Similar to the process described in FIG. 4D, in FIG. 6C, the inflatable packer (150) is forced to expand until it makes contact with a solid surface, such as the tubing (117) wall or the casing (108) wall. As a result, the inflatable packer (150) provides isolation between the high-pressure formation fluid (102) above the inflatable packer (150) and lower-pressure formation fluid (102) below the inflatable packer (150). Should the pressure within the fluid chamber (166) exceed the pressure threshold, the pressure relief valve (174) opens to bleed-off excess formation fluid (102) into the well (116) and reduce the pressure within the fluid chamber (166) to the required design limits.

If the setting depth of the resettable packer system (144) within the well (116) needs to be altered, first, the pump (124) is turned off, and the upward flow (178) of the formation fluid (102) is stopped. This is depicted in FIG. 6D. At this instant, the ports (162) of the inner sleeve (146) and the ports (162) of the outer sleeve (148) are still misaligned. In addition, there is still high-pressure formation fluid (102) trapped within the fluid chamber (166) of the resettable packer system (144). Subsequent to the pump (124) being turned off, the upward drag force decreases to zero. In turn, the combined weight of the inner sleeve (146) and the weighted section (181) cause the inner sleeve (146) to slide downwards within the resettable packer system (144). Accordingly, the inner sleeve (146) continues to slide downwards until the downhole end of the inner sleeve (146) rests against the base (156) of the resettable packer system (144), as depicted in FIG. 6E. In this position, the ports (162) of the inner sleeve (146) and the ports (162) of the outer sleeve (148) align with one another. Consequently, fluid communication between the fluid chamber (166) and the bore (164) is re-established. Thereby, the high-pressure formation fluid (102) previously disposed within the fluid chamber (166) is released into the bore (164), causing the inflatable packer (150) to contract and break contact with the casing (108) wall or tubing (117) wall.

Figure 6F:
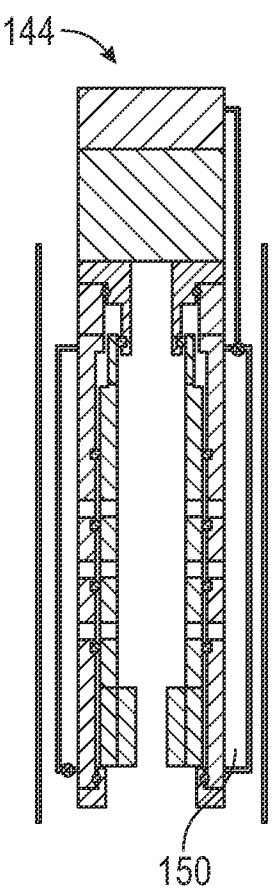
Figure 6E:
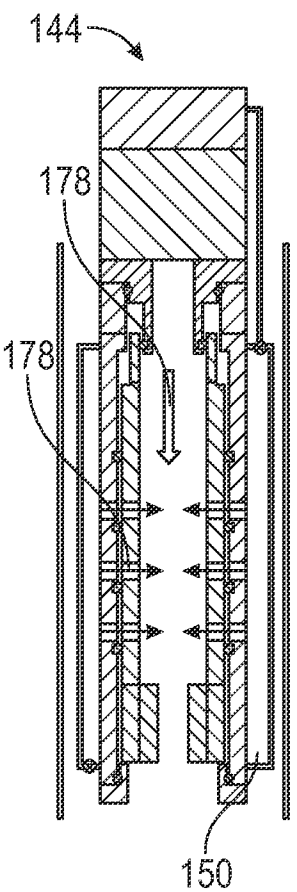
Figure 6D:
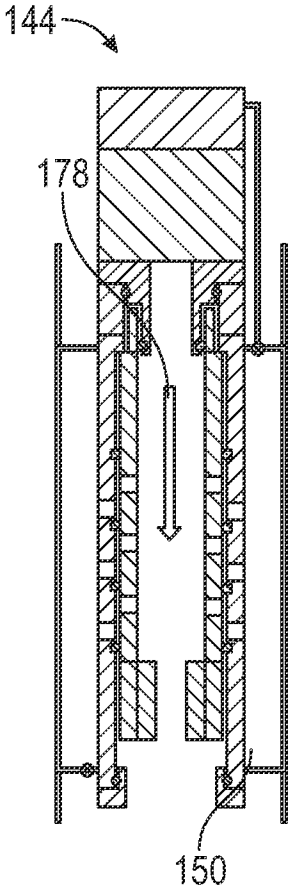

In FIG. 6F, the fluid chamber (166) has been depressurized to downhole ambient pressures (similar to FIG. 6A). The entire bottom hole assembly may be lifted up or down to the newly desired setting depth and the steps depicted by FIGS. 6B and 6C may be repeated to reset the resettable packer system (144). When the entire pumping operation has been completed, the steps depicted by FIGS. 6D and 6E may be performed again, and the entire system (144) may be retrieved to the surface location (114). The positions of the inner sleeve (146) and outer sleeve (148) at the surface location (114) are shown in FIG. 6F, which are the same as in FIG. 6A.

Figure 7:
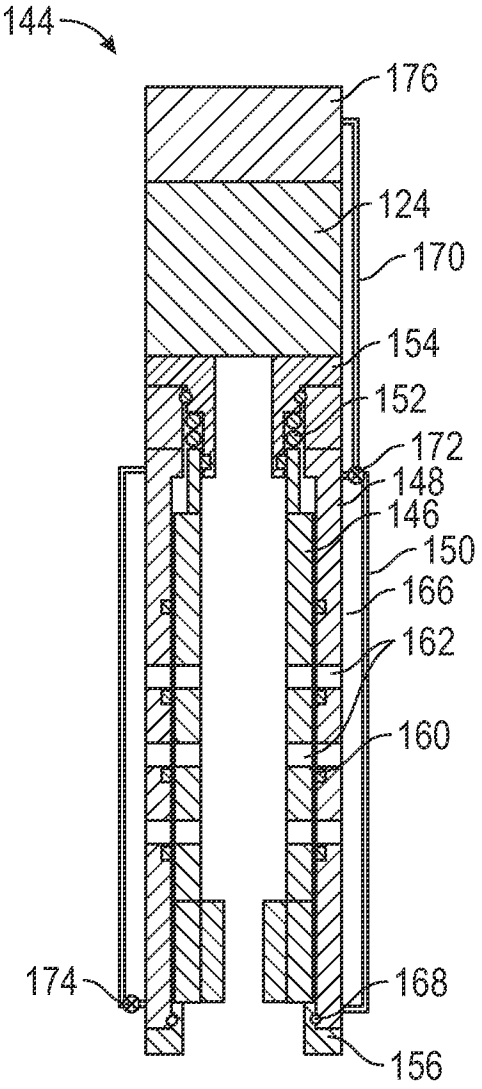
FIG. 7 shows a cross-sectional view of a resettable packer system in accordance with one or more embodiments of the present disclosure.

Since the embodiment depicted by FIGS. 5-6F relies on gravity to ensure the inner sleeve (146) slides downhole to align the ports (162) of the inner sleeve (146) with the ports (162) of the outer sleeve (148), the applicability of this particular embodiment may be constrained to vertical wells (116) or wells (116) with a deviation no more than 30 to 45 degrees from vertical. In order to ensure the inner sleeve (146) is capable of sliding within the resettable packer system (144) in wells (116) with a deviation greater than 30 to 45 degrees from vertical, an additional embodiment of the resettable packer system (144), as depicted in FIG. 7, may be employed. In this particular embodiment, a spring (152) located within a sealed cavity between the wedge (154) and the outer sleeve (148) is utilized to ensure that, irrespective of well (116) deviation, once the drag force is removed, the inner sleeve (146) may still slide within the resettable packer system (144). Accordingly, the spring (152) is attached to the top surface (180) of the inner sleeve (146). The spring force of the spring (152) pushes the inner sleeve (146) downhole to make contact with the base (156) of the resettable packer system (144), thereby ensuring that even in very deviated wells, the ports (162) may align and the fluid chamber (166) may be adequately depressurized to facilitate resetting the system (144).

Figure 8:
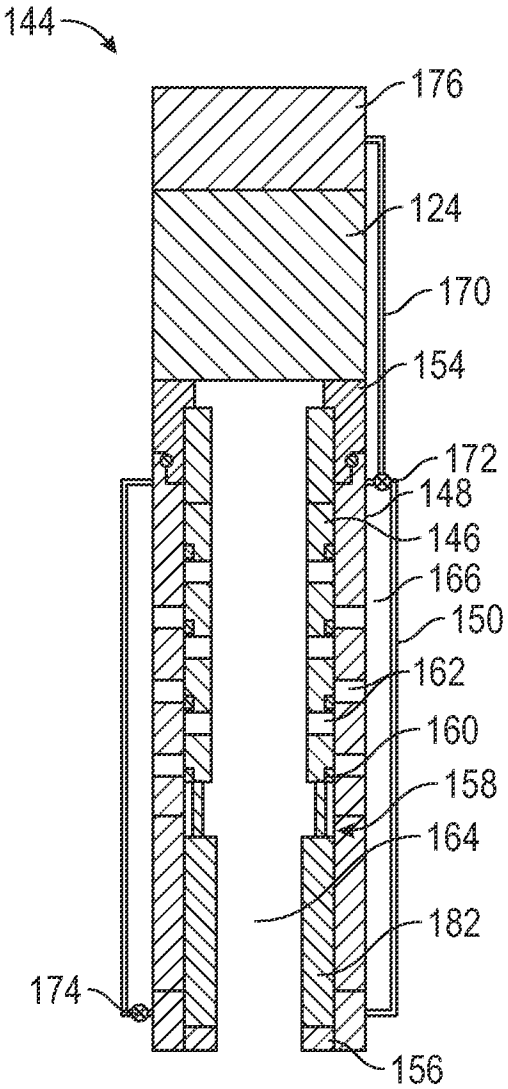
FIG. 8 shows a cross-sectional view of a resettable packer system in accordance with one or more embodiments of the present disclosure.

FIG. 8 shows another embodiment of a resettable packer system (144). In this embodiment, a piston or a plurality of pistons (182) are utilized to slide the inner sleeve (146). The plurality of pistons (182) may be formed of low carbon steel or an aluminum alloy and each include a cylindrical body and a plunger. The cylindrical body of each piston (182) may be attached to the base (156) or wedge (154) of the resettable packer system (144) while the plunger of each piston (182) may be attached to the top surface (180) or bottom surface of the inner sleeve (146). The plurality of pistons (182) are configured to control the position of the inner sleeve (146) within the resettable packer system (144), thereby aligning or misaligning the ports (162) of the outer sleeve (148) and inner sleeve (146).

In the embodiment depicted in FIG. 8, the plurality of pistons (182) are double acting pistons, which when actuated, force the plungers to retract within the cylindrical bodies or eject from the cylindrical bodies outwardly. In other embodiments of the resettable packer system (144), another form of piston (182) may be utilized, such as a single acting piston, which when actuated, move in one direction. Further, the plurality of pistons (182) may be actuated hydraulically via the hydraulic line of the ESP string (112) and remotely controlled at the surface location (114). Upon actuation of the plurality of pistons (182), each plunger of the plurality of pistons (182) similarly either travels within or away from the cylindrical bodies of the plurality of pistons (182), thereby moving the attached inner sleeve (146) such that the ports (162) of the inner sleeve (146) align or misalign with the ports (162) of the outer sleeve (148).

Figure 9:
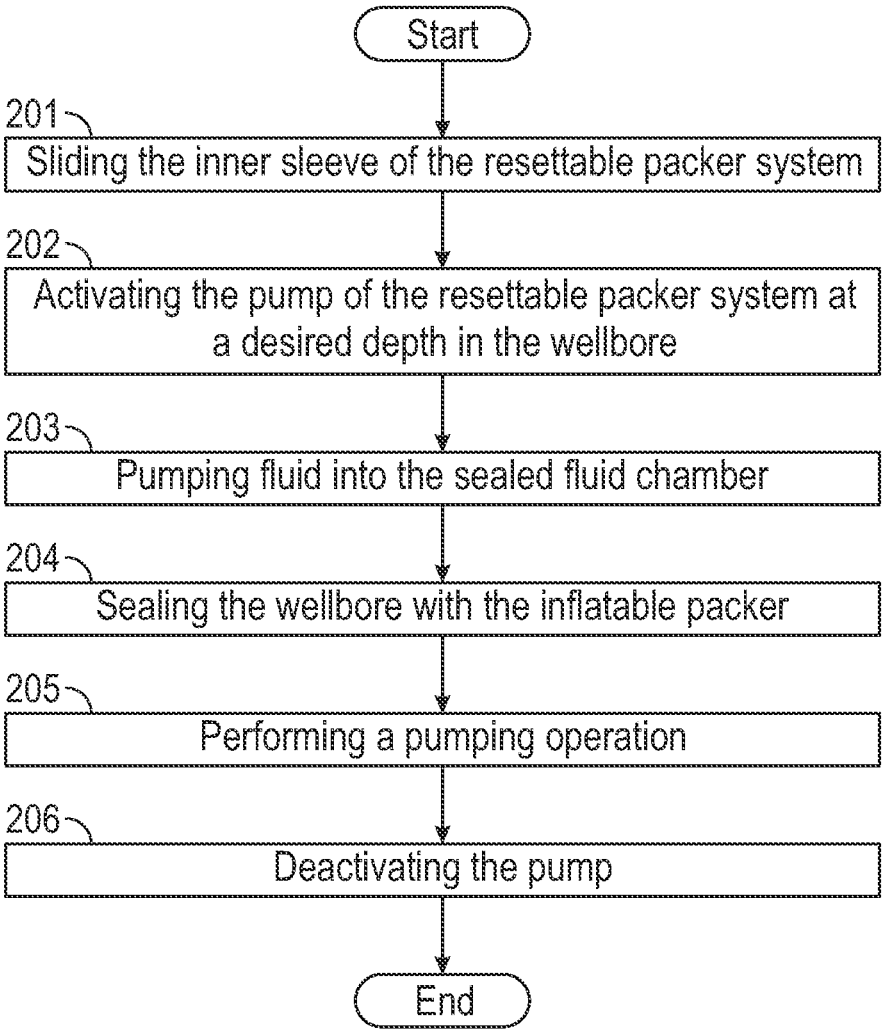
FIG. 9 shows a flowchart of a method in accordance with one or more embodiments of the present disclosure.

FIG. 9 depicts a flowchart showing a method for setting and unsetting a resettable packer system (144). While the various flowchart blocks in FIG. 9 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 201, the inner sleeve (146) of the resettable packer system (144) slides along the inner surface (158) of the outer sleeve (148) of the resettable packer system (144). This first occurs as a hydrostatic force pushes downward on the inner sleeve (146) as the resettable packer system (144) is lowered within the well (116) to a desired depth. Once the resettable packer system (144) reaches the desired depth, the force on the inner sleeve (146) has slid the inner sleeve (146) to a position such that the ports (162) of the inner sleeve (146) and the ports (162) of the outer sleeve (148) are aligned. In turn, the bore (164) of the resettable packer system (144) and the interior of the inflatable packer (150) are in fluid communication. Formation fluid (102) disposed within the bore (164) may flow into the fluid chamber (166) with the inner sleeve (146) in this position.

In block 202, at the desired depth, the pump (124) of the resettable packer system (144) is activated electrically by operators of the well (116) at the surface location (114). Subsequently, a majority of the formation fluid (102) flows upwards through the bore (164) of the resettable packer system (144) towards the ESP system (100) due to a high suction pressure created by the pump (124). In addition, the inner sleeve (146) slides upwards, thereby misaligning the ports (162) of the outer sleeve (148) and the inner sleeve (146). This, in turn, seals the fluid chamber (166) and forces the flow (178) of the formation fluid (102) upwards through the bore (164).

In block 203, the formation fluid (102) is pumped into the sealed fluid chamber (166) by the pump (124). The formation fluid (102) traveling upwards through the bore (164) passes through the pump (124) to the discharge (176). The discharge (176) is connected to the inflatable packer (150) by the control line (170). When the pump (124) has developed pressure greater than the pressure within the fluid chamber (166) of the inflatable packer (150), high-pressure formation fluid (102) passing from the pump (124) to the discharge (176) is introduced into the fluid chamber (166) through the control line (170). The formation fluid (102) passes through a check valve (172) upon exiting the control line (170) and prior to entering the fluid chamber (166). The check valve (172) ensures that the formation fluid (102) only travels in the direction from the discharge (176) to the inflatable packer (150). Further, the inflatable packer (150) begins to expand as the formation fluid (102) is pumped into the fluid chamber (166).

In block 204, when the inflatable packer (150) is fully inflated, the inflatable packer (150) seals the well (116) between the resettable packer system (144) and a tubing (117) wall or a casing (108) wall. The inflatable packer (150) then provides isolation between high-pressure formation fluid (102) above the inflatable packer (150) and lower pressure formation fluid (102) below the inflatable packer (150).

In block 205, a pumping operation may be performed in the well (116). With the inflatable packer (150) fully inflated, the pressure of the formation fluid (102) within the fluid chamber (166) is similar to the pressure of the pump (124). Consequently, the formation fluid (102) being pumped by the pump (124) from below the inflatable packer (150) is now discharged into the production tubing (117) above the inflatable packer (150) by the discharge (176). Subsequently, this formation fluid (102) travels to the surface location (114) to be produced.

In block 206, the pump (124) is deactivated electrically by operators of the well (116) at the surface location (114). This may occur when the desired setting depth of the resettable packer system (144) needs to be changed or if the pumping operations are complete and the resettable packer system (144) needs to be removed from the well (116). Subsequent to the pump (124) being turned off, the direction of the flow (178) of the formation fluid (102) changes. In addition, the pressure upon the inner sleeve (146) increases, causing the inner sleeve (146) to slide downwards, thereby aligning the ports (162) of the outer sleeve (148) and inner sleeve (146). Accordingly, fluid communication between the bore (164) and the fluid chamber (166) is re-established and the high-pressure formation fluid (102) disposed within the fluid chamber (166) exits into the bore (164), flowing back downhole. As the formation fluid (102) exits the fluid chamber (166), the inflatable packer (150) contracts, thereby breaking contact with the tubing (117) wall or casing (108) wall. The resettable packer system (144) may then be removed from the well (116) or lifted up or down to a new desired setting depth.

Accordingly, the aforementioned embodiments as disclosed relate to systems and methods useful for minimizing the time and associated costs of pumping operations. The aforementioned embodiments may be set and unset a number of times in a single operation without the need of retrieving the entire pumping system. The disclosed systems and methods of setting and unsetting a resettable packer system (144) for pumping operations advantageously facilitates faster activation and deactivation of a packer (150), which reduces the time to deploy a bottomhole assembly to different required depths. Further, the disclosed systems and methods advantageously cater for large varying flow rates (with ESP systems (100)) to lift formation fluid (102) from a well (116).

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A resettable packer system for pumping operations, the resettable packer system comprising:

an inflatable packer configured to expand between the resettable packer system and a tubing wall or a casing wall, thereby creating a seal in a well;

a pump configured to inflate the inflatable packer at a desired depth within the well when activated;

an inner sleeve comprising ports for a fluid to pass through; and an outer sleeve, connected to the pump, configured to create a sealed fluid chamber with the inflatable packer when ports of the outer sleeve and the ports of the inner sleeve are misaligned;

wherein the inner sleeve is configured to slide axially along an inner surface of the outer sleeve, thereby aligning or misaligning the ports of the outer sleeve with the ports of the inner sleeve; and wherein the inflatable packer contracts when the pump is inactive.

2. The resettable packer system according to claim 1, wherein the pump, when activated, is configured to inflate the inflatable packer by suppling pressurized fluid to the inflatable packer through a control line connecting the pump and the inflatable packer.

3. The resettable packer system according to claim 2, further comprising a check valve configured to control a fluid flow direction, such that the fluid only flows from the control line into the fluid chamber.

4. The resettable packer system according to claim 1, wherein when the ports of the outer sleeve and the ports of the inner sleeve are aligned, the fluid chamber and the well are in fluid communication.

5. The resettable packer system according to claim 1, further comprising a pressure relief valve configured to eject the fluid from the fluid chamber when a pressure of the fluid chamber exceeds a pressure threshold.

6. The resettable packer system according to claim 1, further comprising a plurality of seals configured to prevent the fluid from flowing through a gap disposed between the outer sleeve and the inner sleeve.

7. The resettable packer system according to claim 1, further comprising a spring configured to slide the inner sleeve.

8. The resettable packer system according to claim 1, wherein the inner sleeve further comprises a weighted section configured to increase the weight of the inner sleeve and enlarge a cross-sectional area of a downhole end of the inner sleeve.

9. The resettable packer system according to claim 1, further comprising a wedge configured to limit an axial movement of the inner sleeve towards a surface location and connect the outer sleeve and the pump.

10. The resettable packer system according to claim 1, further comprising a base configured to limit an axial movement of the inner sleeve towards a downhole end of the well.

11. The resettable packer system according to claim 10, wherein the outer sleeve is rigidly fixed within the resettable packer system to the base.

12. A method for setting and unsetting a resettable packer system, comprising:

sliding an inner sleeve of the resettable packer system axially along an inner surface of an outer sleeve of the resettable packer system, thereby aligning and misaligning ports of the inner sleeve and ports of the outer sleeve, wherein when the ports of the inner sleeve and the ports of the outer sleeve align, a fluid passes through the ports of the inner sleeve and the ports of the outer sleeve, and when the ports of the inner sleeve and the ports of the outer sleeve misalign, the fluid is prevented from passing through the ports of the inner sleeve and the ports of the outer sleeve;

activating a pump of the resettable packer system at a desired depth in a well;

pumping, by the activated pump, the fluid into a sealed fluid chamber between the outer sleeve and an inflatable packer, thereby inflating the inflatable packer;

sealing, by the inflated packer, the well between the resettable packer system and a tubing wall or a casing wall;

performing a pumping operation within the well; and deactivating the pump, thereby contracting the inflatable packer.

13. The method according to claim 12, wherein prior to sliding the inner sleeve, lowering the resettable packer system within the well to the desired depth.

14. The method according to claim 13, wherein, prior to lowering the resettable packer system to the desired depth, a top surface of the inner sleeve rests upon a wedge connecting the outer sleeve and the pump.

15. The method according to claim 14, wherein when resting the top surface of the inner sleeve on the wedge, the ports of the inner sleeve and the ports of the outer sleeve are misaligned.

16. The method according to claim 13, wherein when lowering the resettable packer system within the well to the desired depth, the fluid applies pressure along the inner sleeve, thereby sliding the inner sleeve downward, thereby aligning the ports of the inner sleeve and the ports of the outer sleeve.

17. The method according to claim 16, wherein when aligning the ports of the inner sleeve and the ports of the outer sleeve, the fluid chamber fills with the fluid.

18. The method according to claim 12, wherein subsequent to activating the pump of the resettable packer system at a desired depth in a well, the ports of the inner sleeve and the ports of the outer sleeve misalign, thereby sealing the fluid within the fluid chamber.

19. The method according to claim 12, wherein deactivating the pump further comprises determining to alter the desired depth of the resettable packer system and aligning the ports of the inner sleeve and the ports of the outer sleeve, thereby causing the fluid to exit the fluid chamber, and in turn, causing the inflatable packer to contract and disengage from the tubing wall or casing wall.

20. The method according to claim 19, further comprising activating the pump and resuming the pumping operation subsequent to repositioning the resettable packer system at a new desired depth.

* * * * *